US007590255B2

(12) United States Patent
Nielsen

(10) Patent No.: US 7,590,255 B2
(45) Date of Patent: Sep. 15, 2009

(54) RETAINING MEMBER FOR AN EARPIECE

(75) Inventor: Henrik Nielsen, Roskilde (DK)

(73) Assignee: GN Resound A/S (DK)

( * ) Notice: Subject to any disclaimer, the term of this patent is extended or adjusted under 35 U.S.C. 154(b) by 0 days.

(21) Appl. No.: 10/778,646

(22) Filed: Feb. 13, 2004

(65) Prior Publication Data

US 2005/0002539 A1 Jan. 6, 2005

(30) Foreign Application Priority Data

Feb. 14, 2003 (DK) ..... 2003 00229
Feb. 17, 2003 (DK) ..... 2003 00239

(51) Int. Cl.
*H04R 25/00* (2006.01)

(52) U.S. Cl. ..... 381/328; 381/330; 381/380

(58) Field of Classification Search ..... 381/23.1, 381/322, 324, 326, 327, 328, 329, 330, 380, 381/381, 382; 181/135, 130, 129
See application file for complete search history.

(56) References Cited

U.S. PATENT DOCUMENTS

| | | | | |
|---|---|---|---|---|
| 2,763,334 | A * | 9/1956 | Starkey | 181/135 |
| 2,874,231 | A | 2/1959 | Wallace | |
| 3,732,282 | A | 5/1973 | DeWitt | |
| 3,732,382 | A | 5/1973 | Dewitt | |
| 4,881,616 | A | 11/1989 | Janssen et al. | 181/129 |
| 5,048,090 | A | 9/1991 | Geers | |
| 5,677,964 | A | 10/1997 | Sun | 381/187 |
| 6,021,207 | A | 2/2000 | Puthuff et al. | |
| 6,275,596 | B1 | 8/2001 | Fretz et al. | |
| 2002/0172386 | A1 | 11/2002 | Bayer | 381/330 |
| 2003/0002700 | A1 * | 1/2003 | Fretz et al. | 381/330 |
| 2003/0112992 | A1 * | 6/2003 | Rapps | 381/381 |

FOREIGN PATENT DOCUMENTS

| | | |
|---|---|---|
| DE | 297 18 483 U1 | 2/1999 |
| JP | 4319841 | 11/1992 |
| WO | WO 99/04601 | 1/1999 |
| WO | WO 02/052890 | 7/2002 |

OTHER PUBLICATIONS

English translation of previously filed German Patent No. 29718483 issued Feb. 18, 1999.

Sonotone Corporation "The human ear in anatomical transparencies" Copyright 1946, Sonotone Corporation, Elmsford, New York, p. 53 and Figure 34.

Gray, Henry "Anatomy of the Human Body" Philadelphia: lea & Febiger, 1918: pp. 1033-1037, Bartleby.com, 2000. www.bartleby.com/107/.

(Continued)

*Primary Examiner*—Huyen D Le
(74) *Attorney, Agent, or Firm*—Vista IP Law Group, LLP.

(57) ABSTRACT

An earpiece is provided that is adapted for insertion into the ear canal and has at least one resilient fibre that is connected to the earpiece for abutting a surface of the outer ear when the earpiece has been inserted in the ear canal thereby providing retention of the earpiece in the ear canal of the user.

52 Claims, 2 Drawing Sheets

OTHER PUBLICATIONS

Danish Office action and Search Report dated Sep. 4, 2003 for PA 2003 00239/P3/JMA.

Creel, Lynn P. et al. "Soft-Solid Instruments: A Positive Solution to the Dynamic Ear Canal" High Performance Hearing Solutions, Jan. 1999: pp. 40-43, vol. 3.

Salvinelli, Fabrizio et al. "The External Ear and the Tympanic Membrane" Catholic University of Sacred Heart, Scand Audiol 1991: pp. 253-256, Rome, Italy.

Gray, Henry "Anatomy of the Human Body" Proceeding of the 2000 Philadelphia: lea & Febiger, 1918: pp. 1033-1037, Bartleby.com. www.bartleby.com/107/.

Creel, Lynn P. et al. "Soft-Solid Instruments: A Positive Solution to the Dynamic Ear Canal" Proceedings of the Jan. 1999 High Performance Hearing Solutions, pp. 40-43, vol. 3.

Salvinelli, Fabrizio et al. "The External Ear and the Tympanic Membrane" Proceedings of the Catholic University of Sacred Heart, Scand Audiol 1991: pp. 253-256, Rome, Italy.

Grenness, Malcolm et al. "Mapping Ear Canal Movement Using Area-Based Surface Matching" Proceedings of the 2002 Acoustical Society of America (Feb. 2002) pp. 960-971.

* cited by examiner

RETAINING MEMBER FOR AN EARPIECE

RELATED APPLICATION DATA

This application claims priority to, and the benefit of, Danish Patent Application No. PA 2003 00229, filed on Feb. 14, 2003, and Danish Patent Application No. PA 2003 00239, filed on Feb. 17, 2003.

FIELD OF THE INVENTION

The present invention relates to retaining an earpiece in the ear canal of a user.

PRIOR ART

Behind-the-ear hearings aids in which a sound tube conducts sound generated by the receiver of the hearing aid into the ear canal are well known in the art. In order to position the sound tube securely and comfortably in the ear canal, an earpiece is provided for insertion into the ear canal of the user. Typically, the earpiece is individually adapted to the human anatomy of the ear of the user.

So-called "open" BTE earpieces are generally preferred in order to affect the ear canal as little as possible by avoiding blockage of the ear canal, i.e. the occlusion effect. This also assists in maintaining the natural hearing capacity of the user.

A known earpiece which secures the end of the flexible hearing aid tube within the ear canal has to be individually custom manufactured to fit the user's ear to sufficiently secure the hearing aid tube in place in the ear canal and prevent the earpiece from falling out of the ear and avoid acoustical feed backs, e.g., when the user is moving around. The custom made earpiece adds to the cost of the device and the time needed to fit the hearing aid.

Some standard sized earpieces are available which are generally used during a trial period when the hearing aid is being tested or while the earpiece is being made. Some of these standard sized earpieces are formed of hard materials, some are formed of solid rubber, and some are formed of foam. In general, standard sized earpieces which are currently available have problems with holding the end of the flexible hearing aid tube securely in place because of the shape of the ear canal and because the ear canal is moving when talking and eating. When these standard sized earpieces fit tight122 enough to hold the tube in the ear they are usually uncomfortable mainly because of the constant pressure.

SUMMARY OF THE INVENTION

Accordingly it is among the objects of the present invention to provide an earpiece that is comfortable and aesthetical and that can be securely and comfortably fastened in the ear canal of a user, and that is provided in standard sizes for substituting custom made earpieces.

According to a first aspect of the invention, an earpiece is provided that is adapted for insertion into the ear canal and has at least one resilient fiber that is connected to the earpiece for abutting a surface of the outer ear when the earpiece has been inserted in the ear canal thereby providing retention of the earpiece in the ear canal of the user.

The earpiece may further comprise a sound tube for conducting sound to the ear canal.

In a preferred embodiment, the at least one fiber is connected to the earpiece via the sound tube. However, in another embodiment the at least one fiber is connected directly to the earpiece.

The sound tube may have a pre-formed shape that includes a first bend extending from the case over the top of the ear of the user and a second bend extending from an outside of the ear into an ear canal of the user.

The earpiece is configured to fit within the ear canal and, preferably, without blocking the ear canal so that sound from outside the ear is allowed to propagate through the ear canal, past the earpiece, and to the tympanic membrane. Preferably, the fiber is adapted for abutting the outer ear at the bottom of the ear, e.g. behind the antitragus at the lower part of the concha, at which position the fiber is substantially invisible and provides secure retention of the earpiece in the ear canal.

In a preferred embodiment of the invention, the sound tube has an inner diameter of about 0.9 mm or less and an outer diameter of about 1.6 mm or less. The tube is preferably formed of a material with a durometer of 65 to 85 Shore D.

The fiber may be formed into the desired arcuate shape by any known pre-forming process, such as, heat forming or UV light forming or molding. The earpiece, the sound tube, and the fiber may be molded to form one integrated part, or, the sound tube and the fiber may be molded to form one integrated part to be assembled with the earpiece.

Alternatively, the fiber may be connected to the sound tube with a connector member. The connector member may be over-molded onto the sound tube and the fiber. Alternatively, the connector member may be molded first and then bonded to the tube and fiber, respectively.

Preferably, the fiber has an outer diameter of about 1.0 to 1.6 mm, more preferred about 1.2 mm.

The fiber is preferably produced from a material, which can be formed in a pre-formed shape and exhibits sufficient rigidity to hold the earpiece within the ear canal and retains its shape when positioned in the ear. Examples of fiber materials include REP Teflon, Nylon, PEBAX, silicone, polyurethane, PTFE (polytetrafluoroethylene), EVA (ethylvinylacetate), etc. The material of the fiber may have a shore hardness of about 65 to 85 Shore D, preferably about 72 Shore D.

The resilience of the fiber allows the fiber to apply a force to the earpiece towards the ear canal to retain the earpiece in a position in which the earpiece is pressed against an anatomical feature within the ear canal.

The earpiece material may be a soft elastomer, such as silicone rubber or other soft plastic. The earpiece material preferably has a durometer of about 30 Shore A.

BRIEF DESCRIPTION OF THE DRAWINGS

Below, the invention will be further described and illustrated with reference to the accompanying drawings in which.

DETAILED DESCRIPTION OF PREFERRED EMBODIMENTS

The exemplifying embodiment described below relates to an earpiece for a behind-the-ear hearing aid. However, it should be understood that the invention may be utilized with any earpieces requiring retention in the ear canal provided in standard sizes or custom made, such as completely-in-the-canal (CIC) hearing aids, in-the-canal (ITE) hearing aids, behind-the-ear (BTE) hearing aids.

Figure 1:
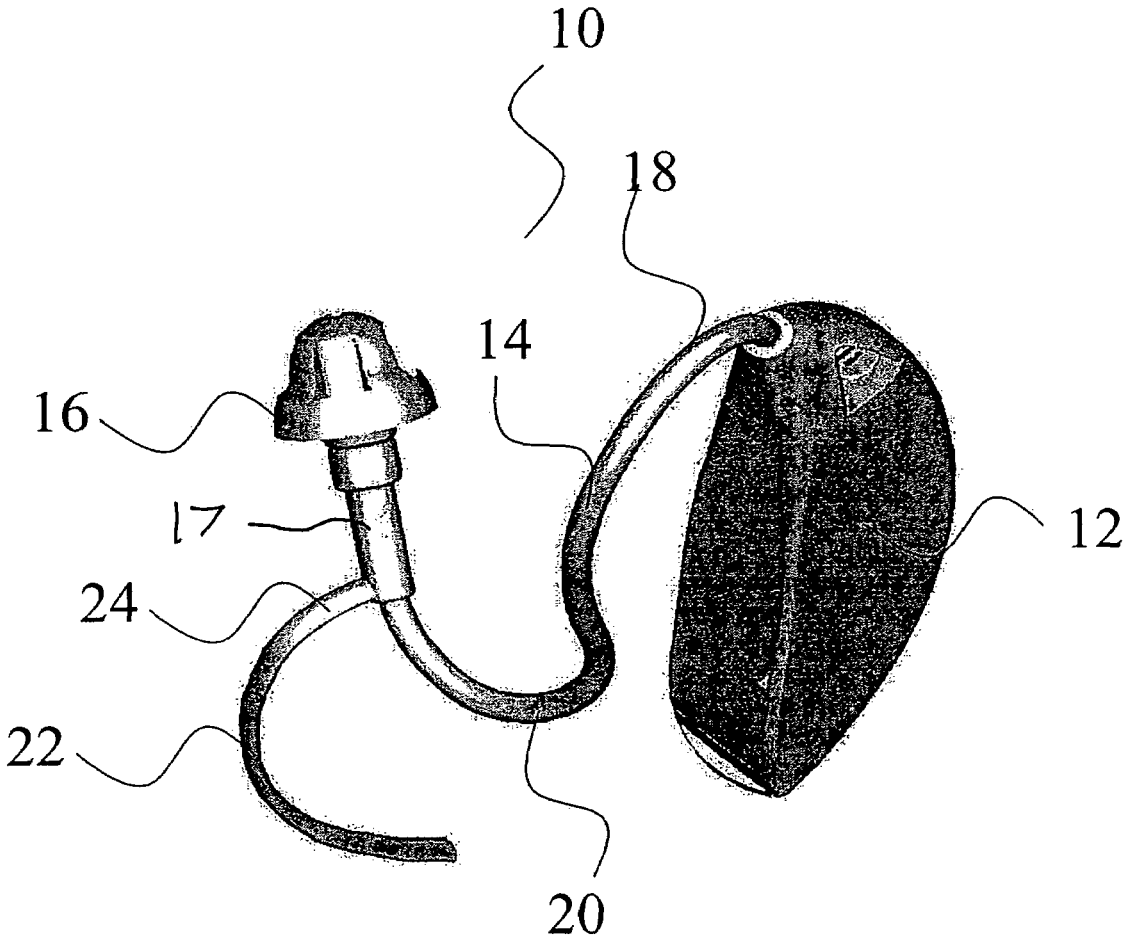
FIG. 1 is a perspective view of a first embodiment of the invention.

FIG. 1 shows in perspective a BTE hearing aid 10 according to the invention. The BTE hearing aid 10 comprises a hearing aid housing 12, a sound tube 14 having a pre-formed shape for conducting sound from the hearing aid housing 12 to the ear canal (not shown), and an earpiece 16 attached to the sound tube 14 via a connector member 17 and inserted into the ear canal.

The hearing aid housing 12 is configured to be worn behind the ear of a user and contains a battery, a microphone, a processor, and a receiver (not shown) for generating sound that is input into the sound tube 14.

The pre-formed shape of the sound tube 14 includes a first bend 18 extending from the case over the top of the ear of the user and a second bend 20 extending from an outside of the ear into an ear canal of the user when the hearing aid 10 is worn by the user.

The earpiece 16 is configured to fit within the ear canal and, preferably, allows sounds outside and within the ear to pass through the ear canal around the earpiece.

Further, the hearing aid 10 has an arcuate, preferably resilient, fiber 22 with one end 24 that is connected to the earpiece 16 or the sound tube 14 via the connector member 17. The fiber 22 may optionally be removably connected to the earpiece 16. The fiber 22 is adapted for abutting a surface of the outer ear when the earpiece 16 has been inserted in the ear canal thereby providing retention of the earpiece 16 in the ear canal of the user.

Figure 2:
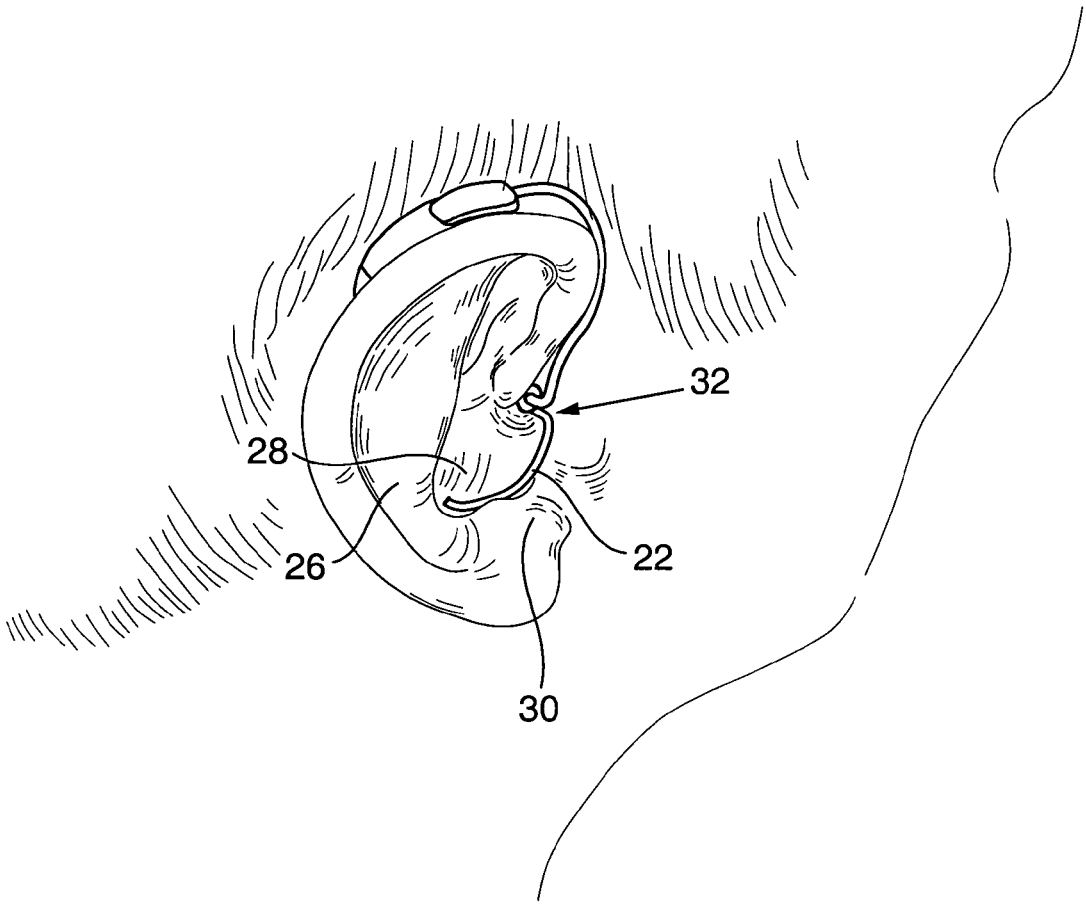
FIG. 2 is a side view of the hearing aid of FIG. 1, positioned at a user's right ear.

Referring to FIG. 2, the fiber 22 is adapted for abutting the outer ear 26 at the lower part of the concha 28 behind the antitragus 30 at which position the fiber 22 is substantially invisible and provides secure retention of the earpiece 16 in the ear canal 32.

The resilience of the fiber allows the fiber to apply a force to the earpiece towards the ear canal to retain the earpiece in a position in which the earpiece is pressed against an anatomical feature within the ear canal.

The illustrated earpiece is provided in standard sizes (i.e. they are not custom made) and is comfortable to wear and aesthetical and the fiber 22 enables it to be securely and comfortably fastened in the ear canal of a user.

It should be noted that presence of the fiber 22 causes practically no detrimental effect on the natural appearance of the external ear.

The invention claimed is:

1. An earpiece assembly for a hearing aid, comprising:

an earpiece for insertion into an ear canal of a user; and at least one elongated resilient fiber extending between a free end and an end connected to the earpiece, wherein the at least one resilient fiber is configured for abutting an outer ear at a bottom of an ear behind an antitragus when the earpiece has been inserted in the ear canal;

wherein the at least one elongated resilient fiber has a resiliency that allows the at least one elongated resilient fiber to push the earpiece with a force component that is towards the ear canal and to press the earpiece against an anatomical feature within the ear canal to thereby retain the earpiece in the ear canal during use.

2. The earpiece assembly according to claim 1, further comprising a tube connected to the earpiece.

3. The earpiece assembly according to claim 2, wherein the at least one fiber is connected to the earpiece via the tube.

4. The earpiece assembly according to claim 2, wherein the tube has a pre-formed shape including a first bend to extend over the top of the ear of the user and a second bend to extend from an outside of the ear into an ear canal of the user when the hearing aid is worn by the user.

5. The earpiece assembly of claim 2, wherein the tube is for conducting sound to the ear canal.

6. The earpiece assembly according to claim 1, wherein the at least one fiber is an integrated part of the tube.

7. The earpiece assembly according to claim 1, further comprising a connector member for interconnection of the fiber with the earpiece.

8. The earpiece assembly according to claim 7, wherein the connector member is over-molded onto the tube and the fiber.

9. The earpiece assembly according to claim 7, wherein the connector member is molded and bonded to the tube and the fiber, respectively.

10. The earpiece assembly according to claim 1, wherein the fiber is made of a material selected from the group consisting of REP Teflon, Nylon, PEBAX, silicone, polyurethane, PTFE (polytetrafluoroethylene), and EVA (ethylvinylacetate).

11. The earpiece assembly according to claim 1, wherein the material of the fiber has a shore hardness of about 65 to 85 Shore D.

12. The earpiece assembly according to claim 1, wherein the at least one fiber is removably connected to the earpiece.

13. The earpiece assembly of claim 1, wherein the fiber has an arcuate configuration.

14. The earpiece assembly of claim 1, wherein a first portion of the fiber has a same cross-sectional dimension as a second portion of the fiber.

15. The earpiece assembly of claim 1, wherein the fiber has a length that is longer than a cross-sectional dimension of the fiber.

16. The earpiece assembly of claim 1, wherein the earpiece has a curvilinear tip.

17. The earpiece assembly of claim 16, wherein the earpiece has a shape that resembles a dome.

18. The earpiece assembly of claim 1, wherein the at least one elongated resilient fiber has a first curvature when the earpiece is not inserted into the ear canal, and a second curvature that is different from the first curvature when the earpiece is inserted into the ear canal.

19. The earpiece assembly of claim 1, wherein the at least one elongated resilient fiber is configured to retain the earpiece in the ear canal of the user even when the user is having jaw movement.

20. A hearing aid, comprising:

a housing containing electronic componentry;

a tube coupled to the housing;

an earpiece coupled to the tube, the earpiece adapted for insertion into an ear canal of a user; and at least one elongated resilient fiber extending between a free end and an end connected to the earpiece, wherein the at least one resilient fiber is configured for abutting an outer ear at a bottom of an ear behind an antitragus when the earpiece has been inserted in the ear canal;

wherein the at least one elongated resilient fiber has a resiliency that allows the at least one elongated resilient fiber to push the earpiece with a force component that is towards the ear canal and to press the earpiece against an anatomical feature within the ear canal to thereby retain the earpiece in the ear canal during use.

21. The hearing aid according to claim 20, wherein the tube has a pre-formed shape including a first bend to extend from the housing over the top of the ear of the user and a second bend to extend from an outside of the ear into an ear canal of the user when the hearing aid is worn by the user.

22. The hearing aid according to claim 20, wherein the at least one fiber is an integrated part of the tube.

23. The hearing aid according to claim 20, further comprising a connector member for interconnection of the fiber with the earpiece.

24. The hearing aid according to claim 20, wherein the fiber is made of a material selected from the group consisting of REP Teflon, Nylon, PEBAX, silicone, polyurethane, PTFE (polytetrafluoroethylene), and EVA (ethylvinylacetate).

25. The hearing aid according to claim 20, wherein the material of the fiber has a shore hardness of about 65 to 85 Shore D.

26. The hearing aid according to claim 20, wherein the hearing aid is selected from the group consisting of a completely-in-the-canal (CIC) hearing aid, an in-the-canal (TIE) hearing aid, and a behind-the-ear (BTE) hearing aid.

27. The hearing aid of claim 20, wherein a first portion of the fiber has a same cross-sectional dimension as a second portion of the fiber.

28. The hearing aid of claim 20, wherein the fiber has a length that is longer than a cross-sectional dimension of the fiber.

29. The hearing aid of claim 20, wherein the fiber has an arcuate configration.

30. The hearing aid of claim 20, wherein the earpiece has a curvilinear tip.

31. The hearing aid of claim 30, wherein the earpiece has a shape that resembles a dome.

32. The hearing aid of claim 20, wherein the tube comprises a sound tube.

33. The hearing aid of claim 20, wherein the at least one elongated resilient fiber has a first curvature when the earpiece is not inserted into the ear canal, and a second curvature that is different from the first curvature when the earpiece is inserted into the ear canal.

34. The hearing aid of claim 20, wherein the at least one elongated resilient fiber is configured to retain the earpiece in the ear canal of the user even when the user is having jaw movement.

35. An assembly for a hearing aid, comprising:

a component for insertion into an ear canal of a user, the component having a surface for contacting an anatomical feature of the ear canal; and at least one elongated resilient fiber extending between a free end and an end connected to the component, wherein the at least one resilient fiber is configured for abutting an outer ear at a bottom of an ear behind an antitragus when the component has been inserted in the ear canal;

wherein the at least one resilient fiber has a cross-sectional dimension, the cross-sectional dimension being a value selected from a range of 1 mm to 1.6 mm; and wherein the at least one resilient fiber has a resiliency and shape that allows the fiber to push the component with a force component in a direction that is towards the ear canal, thereby retaining the component in the ear canal during use.

36. An assembly for a hearing aid, comprising:

a component for insertion into an ear canal of a user, the component having a surface for contacting an anatomical feature of the ear canal; and at least one elongated resilient fiber extending between a free end and an end connected to the component, wherein the at least one resilient fiber is configured for abutting an outer ear at a bottom of an ear behind an antitragus when the component has been inserted in the ear canal;

wherein the at least one resilient fiber has a C-shape when the component is in the ear canal; and wherein the at least one resilient fiber has a resiliency and shape that allows the fiber to push the component with a force component in a direction that is towards the ear canal, thereby retaining the component in the ear canal during use.

37. An assembly for a hearing aid, comprising:

component for insertion into an ear canal of a user, the component having a surface for contacting an anatomical feature of the ear canal; and at least one elongated resilient fiber extending between a free end and an end connected to the component, wherein the at least one resilient fiber is configured for abutting an outer ear at a bottom of an ear behind an antitragus when the component has been inserted in the ear canal;

wherein the end of the at least one fiber connected to the component is indirectly connected to the component; and wherein the at least one resilient fiber has a resiliency and shape that allows the fiber to push the component with a force component in a direction that is towards the ear canal, thereby retaining the component in the ear canal during use.

38. A hearing aid, comprising:

a housing containing electronic componentry;

a tube coupled to the housing;

a component coupled to the tube, the component sized for insertion into an ear canal of a user, and having a surface for contacting an anatomical feature of the ear canal; and at least one elongated resilient fiber extending between a free end and an end connected to the component, wherein the at least one resilient fiber is configured for abutting an outer ear at a bottom of an ear behind an antitragus when the component has been inserted in the ear canal;

wherein the at least one resilient fiber has a cross-sectional dimension, the cross-sectional dimension being a value selected from a range of 1 mm to 1.6 mm; and wherein the at least one resilient fiber has a resiliency and shape that allows the fiber to push the component with a force component in a direction that is towards the ear canal, thereby retaining the component in the ear canal during use.

39. The hearing aid of claim 38, wherein the tube comprises a sound tube.

40. The hearing aid of claim 38, wherein the at least one elongated resilient fiber has a first curvature when the component is not inserted into the ear canal, and a second curvature that is different from the first curvature when the component is inserted into the ear canal.

41. The hearing aid of claim 38, wherein the at least one elongated resilient fiber also presses the component against an anatomical feature within the ear canal.

42. The hearing aid of claim 38, wherein the at least one elongated resilient fiber is configured to retain the component in the ear canal of the user even when the user is having jaw movement.

43. A hearing aid, comprising:

a housing containing electronic componentry;

a tube coupled to the housing;

a component coupled to the tube, the component sized for insertion into an ear canal of a user, and having a surface for contacting an anatomical feature of the ear canal; and at least one elongated resilient fiber extending between a free end and an end connected to the component, wherein the at least one resilient fiber is configured for abutting an outer ear at a bottom of an ear behind an antitragus when the component has been inserted in the ear canal;

wherein the at least one resilient fiber has a C-shape when the component is in the ear canal; and wherein the at least one resilient fiber has a resiliency and shape that allows the fiber to push the component with a force component in a direction that is towards the ear canal, thereby retaining the component in the ear canal during use.

44. The hearing aid of claim 43, wherein the tube comprises a sound tube.

45. The hearing aid of claim 43, wherein the at least one elongated resilient fiber has a first curvature when the component is not inserted into the ear canal, and a second curvature that is different from the first curvature when the component is inserted into the ear canal.

46. The hearing aid of claim 43, wherein the at least one elongated resilient fiber also presses the component against an anatomical feature within the ear canal.

47. The hearing aid of claim 43, wherein the at least one elongated resilient fiber is configured to retain the component in the ear canal of the user even when the user is having jaw movement.

48. A hearing aid, comprising:

a housing containing electronic componentry;

a tube coupled to the housing;

a component coupled to the tube, the component sized for insertion into an ear canal of a user, and having a surface for contacting an anatomical feature of the ear canal; and at least one elongated resilient fiber extending between a free end and an end connected to the component, wherein the at least one resilient fiber is configured for abutting an outer ear at a bottom of an ear behind an antitragus when the component has been inserted in the ear canal;

wherein the end of the at least one fiber connected to the component is indirectly connected to the component; and wherein the at least one resilient fiber has a resiliency and shape that allows the fiber to push the component with a force component in a direction that is towards the ear canal, thereby retaining the component in the ear canal during use.

49. The hearing aid of claim 48, wherein the tube comprises a sound tube.

50. The hearing aid of claim 48, wherein the at least one elongated resilient fiber has a first curvature when the component is not inserted into the ear canal, and a second curvature that is different from the first curvature when the component is inserted into the ear canal.

51. The hearing aid of claim 48, wherein the at least one elongated resilient fiber also presses the component against an anatomical feature within the ear canal.

52. The hearing aid of claim 48, wherein the at least one elongated resilient fiber is configured to retain the component in the ear canal of the user even when the user is having jaw movement.

* * * * *

UNITED STATES PATENT AND TRADEMARK OFFICE

CERTIFICATE OF CORRECTION

PATENT NO. : 7,590,255 B2
APPLICATION NO. : 10/778646
DATED : September 15, 2009
INVENTOR(S) : Henrik Nielsen It is certified that error appears in the above-identified patent and that said Letters Patent is hereby corrected as shown below:

On page 7, column 5, claim 26, "in-the-canal (TIE)" should be "in-the-canal (ITE)."

Signed and Sealed this

First Day of December, 2009

David J. Kappos

David J. Kappos
*Director of the United States Patent and Trademark Office*